United States Patent [19]

Hsieh et al.

[11] Patent Number: 4,609,978

[45] Date of Patent: Sep. 2, 1986

[54] LIGHTING APPARATUS WITH ILLUMINANCE EQUALIZING LENS

[75] Inventors: Kou-Chang Hsieh; Michiya Suzuki, both of Yonezawa, Japan

[73] Assignee: President of Yamagata University, Yamagata, Japan

[21] Appl. No.: 601,647

[22] Filed: Apr. 18, 1984

[30] Foreign Application Priority Data

May 9, 1983 [JP] Japan ..... 58-80277

[51] Int. Cl.[4] ..... F21V 5/00; F21V 5/04

[52] U.S. Cl. ..... 362/335; 362/336; 362/311

[58] Field of Search ..... 362/311, 335, 336

[56] References Cited

U.S. PATENT DOCUMENTS 1,983,818 12/1934 Seiss .
2,621,283 12/1952 Johnson ..... 362/311
3,132,559 5/1964 Kalustyan et al. .
3,235,863 2/1966 Lockhart .

FOREIGN PATENT DOCUMENTS 126092 2/1927 Switzerland ..... 362/355

*Primary Examiner*—Ronald B. Cox
*Attorney, Agent, or Firm*—Robert E. Burns; Emmanuel J. Lobato; Bruce L. Adams

[57] ABSTRACT

In a lighting apparatus which illuminates light ray from an illumination light source through a light distribution lens onto an illuminated surface, an inner surface of the light distribution lens is formed as continuous surface to receive incident ray in the perpendicular direction, and an outer surface of the lens for refracting outgoing ray is formed based on the equations which are made in consideration of the illuminance on the illuminated surface, thereby uniform illuminance is obtained on the illuminated surface.

19 Claims, 4 Drawing Figures

LIGHTING APPARATUS WITH ILLUMINANCE EQUALIZING LENS

BACKGROUND OF THE INVENTION

1. Field of the Invention

The present invention relates to lighting apparatus with an illuminance equalizing lens, and more particularly to a lighting apparatus with an illuminance equalizing lens in which the intensity of illumination on an illuminated surface is uniformed.

2. Description of the Prior Art

In a lighting apparatus of the prior art, a light ray from a light source such as an electric bulb is distributed roughly by installing a reflector, a shade, a globe or a bowl so that the intensity of illumination on an illuminated surface is strong at portions near the light source and weak at portions remote therefrom. However, the equalized distribution of light rays on an illuminated surface cannot be obtained by the above-mentioned lighting apparatus of the prior art.

SUMMARY OF THE INVENTION

In order to eliminate the above-mentioned disadvantage of the prior art, an object of the present invention is to provide a lighting apparatus with an illuminance equalizing lens wherein the intensity of illumination on an illuminated surface is equalized by designing a lens utilizing the principle of ray-theory, so that a higher illumination effect, energy saving in the illumination and an economical illumination system can be obtained.

A lighting apparatus with an illuminance equalizing lens of the invention therefore comprises an illumination light source and a lens for illuminating a luminous vector or light ray from the light source onto an illuminated surface, characterized in that an inner surface of the lens is formed as a continuous surface (smooth surface) to receive the luminous vector from the light source in the normal direction thereof, and in order to obtain the uniform illuminance on the illuminated surface, the distance r(ϕ) from the light source to an outer surface of the lens where the angle from the reference plane is perpendicular with the illuminating direction onto the illuminating surface is ϕ is given by the following equation:

$$r(\phi) = r(\phi_1)\exp\left\{\int_{\phi_1}^{\phi-\phi_1} \tan\theta_i d\phi\right\} \tag{1}$$

wherein $$\tan\theta_i = \frac{\sin(\theta(\phi)-\phi)}{n-\cos(\theta(\phi)-\phi)} \tag{2}$$

$$\theta(\phi) = \tan^{-1}\left\{\frac{1}{\cot\theta_2 + (\cot\theta_1 - \cot\theta_2)\dfrac{\int_{\phi_2}^{\phi} I(\phi)d\phi}{\int_{\phi_2}^{\phi_1} I(\phi)d\phi}}\right\} \tag{3}$$

$\phi_1$: angle from the reference plane to periphery of the outer surface $\phi_2$: angle from the reference plane to the center of the outer surface $\theta_i$: incident angle of the luminous vector to the normal of the outer surface $\theta_{(\phi)}$: angle of refraction of the luminous vector to the reference plane $\theta_1$: angle of refraction of the luminous vector to the reference plane at $\phi=\phi_1$ $\theta_2$: angle of refraction of the luminous vector to the reference plane at $\phi=\phi_2$ n: refractive index of the lens I(ϕ): illuminance distribution pattern from the illumination light source Further a lighting apparatus with an illuminance equalizing lens of the invention comprises light-omitting means in the form of an illumination light source for emitting luminous vectors or light rays and a lens for illuminating the luminous vectors or light rays from the light source onto an illuminated surface, characterized in that an inner surface of the lens is formed as a continuous surface to receive the luminous vectors from the light source in the normal directions thereof, and in order to obtain the uniform illuminance on the illuminated surface, the distance r(ϕ) from the light source to an outer surface of the lens where the angle from the reference plane is perpendicular with the illuminating direction onto the illuminated surface is ϕ is given by following equation:

$$r(\phi) = r(\phi_1)\exp\left\{\int_{\phi_1}^{\phi-\phi_1} \tan\theta_i d\phi\right\} \tag{1'}$$

wherein $$\tan\theta_i = \frac{\sin(\theta(\phi)-\phi)}{n-\cos(\theta(\phi)-\phi)} \tag{2'}$$

$$\theta(\phi) = \tag{3'}$$

$$\tan^{-1}\left\{\left(\frac{1}{\cot^2\theta_2 + (\cot^2\theta_1 - \cot^2\theta_2)\dfrac{\int_{\phi_2}^{\phi} I(\phi)d\phi}{\int_{\phi_2}^{\phi_1} I(\phi)d\phi}}\right)^{\frac{1}{2}}\right\}$$

$\phi_1$: angle from the reference plane to periphery of the outer surface $\phi_2$: angle from the reference plane to the center of the outer surface $\theta_i$: incident angle of the luminous vector to the normal of the outer surface $\theta_{(\phi)}$: angle of refraction of the luminous vector to the reference plane $\theta_1$: angle of refraction of the luminous vector to the reference plane at $\phi=\phi_1$ $\theta_2$: angle of refraction of the luminous vector to the reference plane at $\phi=\phi_2$ n: refractive index of the lens I(ϕ): illuminance distribution pattern from the illumination light source Accordingly, a lighting apparatus with an illuminance equalizing lens of the invention has advantages in that the intensity of illumination on the illuminated surface is equalized, and a higher illumination effect, energy saving in the illumination and economical illuminating fittings can be obtained.

BRIEF DESCRIPTION OF THE DRAWINGS

The accompanying drawings illustrate lighting apparatuses with an illuminance equalizing lens as embodiments of the invention.

DESCRIPTION OF THE PREFERRED EMBODIMENTS

Lighting apparatuses with an illuminance equalizing lens as embodiments of the invention will now be described referring to the accompanying drawings.

Figure 1:
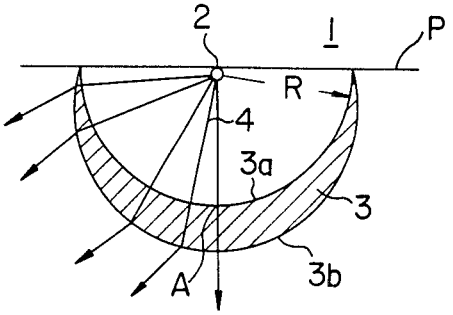
FIG. 1 is a sectional view of one embodiment of a lighting apparatus.
Figure 2:
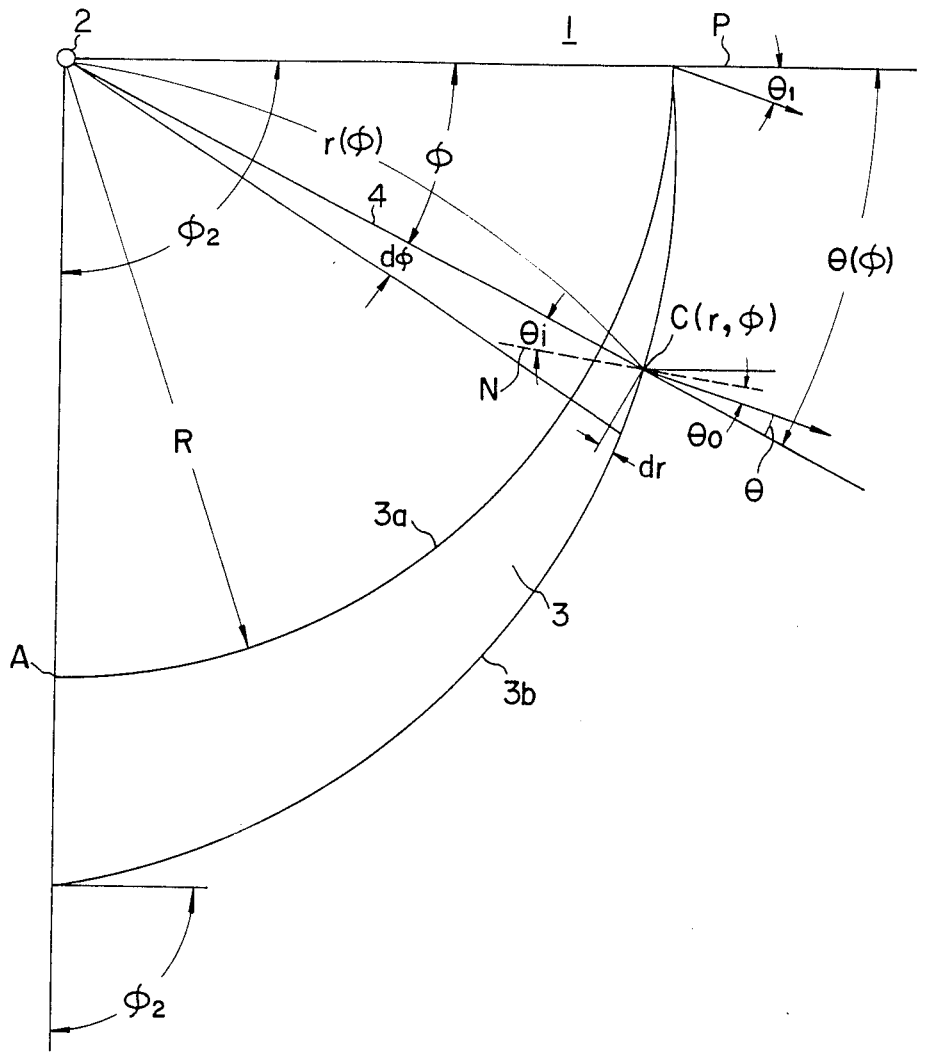
FIG. 2 is an enlarged sectional view illustrating function of the lighting apparatus.

Referring to FIGS. 1 and 2, a lighting apparatus with an illuminance equalizing lens as a first embodiment of the invention comprises a reflector 1 of flat plane arranged in the horizontal direction, a linear light source 2 as an illumination source disposed at the center of the reflector 1, and a light distribution lens 3 installed to cover the light source 2 for distributing light the rays from the light source 2. The light distribution lens 3 is made of a transparent material such as glass or plastics.

An inner surface 3*a* of the light distribution lens 3 is formed into a semi-cylindrical surface of radius R surrounding the light source 2 as the center line thereof.

In order to obtain the uniform illuminance on an illuminated surface 5, an outer surface 3*b* of the light distribution lens 3 is formed so that the distance r(ϕ) from the light source 2 to the outer surface 3*b* is given by the equation hereinafter described. Angle ϕ is taken from the horizontal reference plane P which is orthogonal to the perpendicular line connecting the center point A of the inner surface 3*a* with the light source 2 in the direction of the perpendicular line.

$$r(\phi) = r(\phi_1)\exp\left\{\int_{\phi_1}^{\phi-\phi_1} \tan\theta_i d\phi\right\} \quad (1)$$

wherein tan $\phi_i$ is obtained by eliminating $\theta_{(\phi)}$ from the following equations (2) and (3).

$$\tan\theta_i = \frac{\sin(\theta(\phi)-\phi)}{n-\cos(\theta(\phi)-\phi)} \quad (2)$$

$$\theta(\phi) = \tan^{-1}\left\{\frac{1}{\cot\theta_2 + (\cot\theta_1 - \cot\theta_2)\dfrac{\int_{\phi_2}^{\phi} I(\phi)d\phi}{\int_{\phi_2}^{\phi_1} I(\phi)d\phi}}\right\} \quad (3)$$

As clearly seen from FIG. 2, $\phi_1$ is the angle from the reference plane P to the periphery of the light distribution lens 3 ($\phi_1=0°$ in this embodiment), $\phi_2$ is the angle from the reference plane P to the point A ($\phi_2=90°$), $\theta_i$ is the angle of the incident ray with respect to the normal N at position C(r, ϕ) of angle ϕ on the outer surface 3*b* of the light distribution lens 3, θ is the angle between the outgoing ray and the incident ray at the position C(r, ϕ), $\theta_1$ is the angle θ(ϕ) at $\phi=\phi_1=0°$, $\theta_2$ is the angle θ(ϕ) at $\phi=\phi_2=90°$, and $\theta_2$ becomes 90° in this case. I(ϕ) is the illuminance distribution function of the light source 2, and n is the refractive index of the light distribution lens 3.

Numeral 4 in FIGS. 1–4 designates the optical path, and $\theta_0$ designates the angle of outgoing light with respect to the normal N at C(r, θ). Angle $\theta_0$ may be represented by $\theta_0=\theta_i-\theta$ using angles $\theta_i$ and θ as clearly seen from FIG. 2.

Since the lighting apparatus with the illuminance equalizing lens as a first embodiment of the invention is constituted as described above a, light ray which travels from the light source 2 in the direction of angle θ with respect to the reference plane P is held always in the orthogonal direction with the inner surface 3*a* of the light distribution lens 3 and enters the outer surface 3*b* at position C(r,ϕ) spaced by the distance r from the light source 2. In this case, the incident ray is inclined by angle $\theta_i$ with respect to the normal N of the outer surface 3*b* at the position C(r,ϕ).

A light ray to the outer surface 3*b* is refracted at the position C(r, ϕ) and goes out in the direction of angle $\theta_0$ with respect to the normal N. Angle θ between the outgoing ray and the incident ray is represented by $$\theta=\theta_i-\theta_0$$

On the another hand, when other light ray travels from the light source 2 in the direction inclined by very small angle dϕ to the light ray travelling in angle ϕ with respect to the reference plane P as described above and then reaches the outer surface 3*b*, it is assumed that the distance between the attaining point of the other ray on the outer surface 3*b* and the light source 2 is (r+dr) wherein dr is very small distance.

Figure 3:
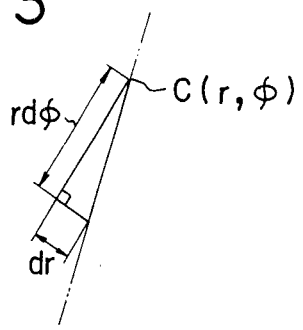
FIG. 3 is an enlarged view of a principal part of FIG. 2.

Assuming that the figure enclosed by the outer surface 3*b*, the circular arc of radius r and the optical path of light ray travelling from the light source 2 in the direction of angle (ϕ+dϕ) with respect to the reference plane P as shown in FIG. 2 is approximately a right-angled triangle with vertex C (r, ϕ) as shown in FIG. 3, the following equation is obtained:

$$\tan\phi_i = dr/rd\phi$$

Since the integration interval is [$\phi_1$, ϕ], the above-mentioned equation becomes $$r(\phi) = r(\phi_1)\cdot\exp\left\{\int_{\phi_1}^{\phi-\phi_1} \tan\theta_i d\phi\right\}$$

($\phi_1=0°$ in this embodiment) thus equation (1) is obtained.

It follows that if a light ray enter in the direction of angle ϕ with respect to the reference plane P and at the incident angle $\theta_i$, the distance r from the light source 2 to the outer surface 3*b* may be represented by ϕ and $\theta_i$.

Figure 4:
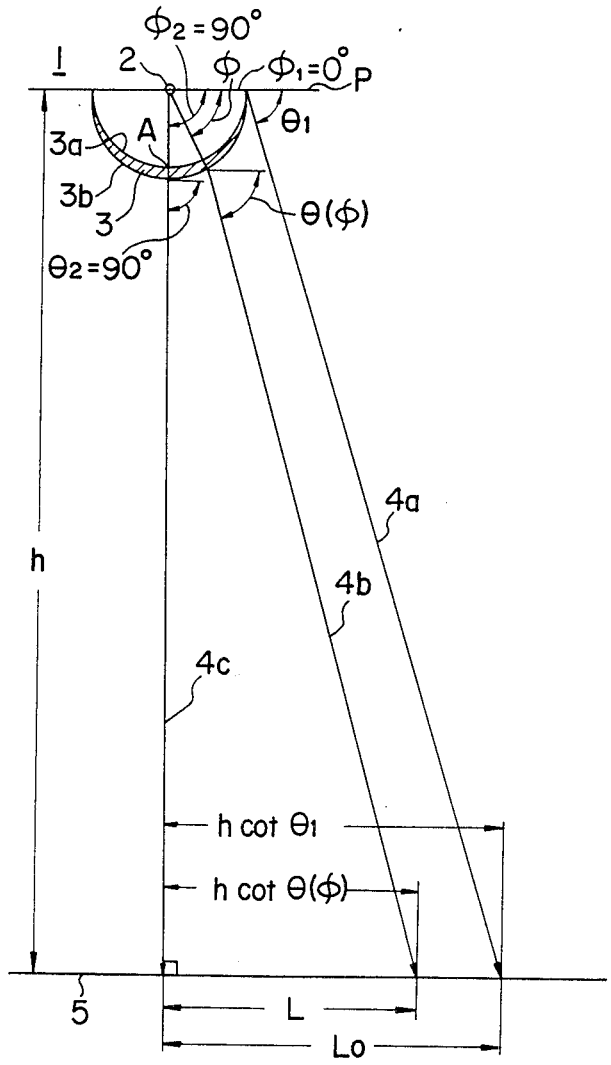
FIG. 4 is a diagrammatic view of the lighting apparatus.

When a light ray travels from the light source 2 in the direction of angle θ with respect to the reference plane P and then goes out of the outer surface 3*b* of the light distribution lens 3 in the direction of $\theta_{(\phi)}$ with respect to the reference plane P as shown in FIG. 4, the outgoing ray travels straight and follows the optical path 4*b* and illuminates the illuminated surface 5 which is parallel to the reference plane P (reflector 1). In such constitution, it is required that the illuminated surface 5 be illuminated uniformly. Consequently, the condition to secure the uniform illumination will be studied.

Referring to FIG. 4, a light ray which travels from the light source 2 in the direction of angle $\phi_1$ ($\phi_1=0°$ in this embodiment) with respect to the reference plane P goes out of the light distribution lens 3 in the direction of angle $\theta_1$ with respect to the reference plane P and then follows optical path 4*a* so as to reach the illuminated surface 5.

A light ray which travels from the light source 2 in the direction of angle $\phi_2$ ($\phi_2=90°$ in this embodiment) with respect to the reference plane P is not refracted at the outer surface 3*b* of the light distribution lens 3 but follows optical path 4*c* straight so as to illuminate the illuminated surface 5 from the vertical direction. That is, the optical path 4*c* coincides with the perpendicular line extending from the light source 2 to the illuminated surface 5 and angle $\theta_2$ at the outer surface 3*b* is 90°.

When a light ray follows the optical paths 4*a*, 4*b*, 4*c* respectively and illuminates the illuminated surface 5, the distances from the perpendicular line extending from the light source 2 to the illuminated surface 5 to the illuminated points are represented by h cot $\theta_1$, h cot $\theta(\phi)$ , h cot $\theta_2$ (=0), provided that the length of the perpendicular line is h and the size of the light distribution lens is sufficiently small in comparison to the length h. When the whole amount of light in the rectangular area enclosed by the optical paths 4*a* and 4*c* (whole illuminated area) is made $L_0$ and also the amount of light in the rectangular area enclosed by the optical paths 4*b* and 4*c* is L, the ratio of $L_0$ to L must coincide with the ratio of the area enclosed by the optical paths 4*a* and 4*c* to the area enclosed by the optical paths 4*b* and 4*c* in order to illuminate the illuminated surface 5 uniformly.

$$L_0:L = (h\cot\theta_1 - h\cot\theta_2):(h\cot\theta(\phi) - h\cot\theta_2) \quad (4)$$
$$= (\cot\theta_1 - \cot\theta_2):(\cot\theta(\phi) - \cot\theta_2)$$

hence $$\theta(\phi) = \tan^{-1}\left\{\frac{1}{\cot\theta_2 + (\cot\theta_1 - \cot\theta_2)\frac{L}{L_0}}\right\}$$

If $L_0$ and L are represented using the illuminance distribution function $I(\phi)$ of the light source 2, $$L_0 = \int_{\phi_2}^{\phi_1} I(\phi)d\phi$$

$$L = \int_{\phi_2}^{\phi} I(\phi)d\phi$$

thus equation (4) is transformed into equation (3).

According to Snell laws of refraction, the relation of the incident angle $\theta_i$ at the outer surface 3*b* to the angle $\phi$ of the incident ray and the angle $\theta(\phi)$ of the outgoing ray with respect to the reference plane P is given by following equation using the refractive index n.

$$\tan\theta_i = \{\sin(\theta(\phi)-\phi)\}/\{n-\cos(\theta(\phi)-\phi)\}$$

Thus equation (2) is obtained.

As described above, if the light distribution lens 3 is so designed that the inner surface 3*a* is in cylindrical form and the outer surface 3*b* complies with equations (1)-(3), the light rays which travel from the light source 2 can illuminate uniformly the illuminated surface 5 spaced by any distance from the light source 2.

Thus according to the first embodiment, the illuminance on the illuminated surface is made uniform, and higher light distribution effect, energy saving in the illumination and the economical illumination system can be obtained. Furthermore, if a lighting apparatus with the illuminance equalizing lens of the invention is used to illuminate a road, for example, comfortable lighting is obtained at the uniform illuminance and therefore this constitution also serves to secure traffic safety.

In a lighting apparatus with an illuminance equalizing lens as a second embodiment of the invention, a light source of spot form is used as the illumination source and a spherical surface is used as the continuous surface.

A light distribution lens is made of a transparent material, and the reference plane is provided with a reflector of flat plane.

The second embodiment is constituted in a similar manner to the first embodiment except for the above-mentioned constitution, and similar also in the principle of light ray refraction at the light distribution lens. Therefore a detailed explanation of such constitution in the second embodiment shall be omitted.

Equations (1) and (2) in the first embodiment apply also to the second embodiment. Referring to FIGS. 1–4, the lighting apparatus in this embodiment has an almost similar cross-section to that of the lighting apparatus having the linear light source 2 in the first embodiment and uniform illuminance is obtained on the illuminated surface 5.

The ratio of the area enclosed by circumferences corresponding to equation (4) becomes $$L_0:L = (h^2\cot^2\theta_1 - h^2\cot^2\theta_2):(h^2\cot^2\theta(\phi) - h^2\cot^2\theta_2) \quad (5)$$
$$= (\cot^2\theta_1 - \cot^2\theta_2):(\cot^2\theta(\phi) - \cot^2\theta_2)$$

hence $$\theta(\phi) = \tan^{-1}\left\{\left(\frac{1}{\cot^2\theta_2 + (\cot^2\theta_1 - \cot^2\theta_2)\frac{L}{L_0}}\right)^{\frac{1}{2}}\right\}$$

If $L_0$ and L are represented using the illuminance distribution function $I(\phi)$ of the light source 2, $$L_0 = \int_{\phi_2}^{\phi_1} I(\phi)d\phi$$

$$L = \int_{\phi_2}^{\phi} I(\phi)d\phi$$

thus equation (5) is transformed into following equation corresponding to equation (3).

$$\theta(\phi) = \quad (3')$$

-continued $$\tan^{-1}\left\{\left(\frac{1}{\cot^2\theta_2 + (\cot^2\theta_1 - \cot^2\theta_2)\dfrac{\int_{\phi_2}^{\phi} I(\phi)d\phi}{\int_{\phi_2}^{\phi_1} I(\phi)d\phi}}\right)^{\frac{1}{2}}\right\}$$

Since the lighting apparatus with the illuminance equalizing lens as a second embodiment of the invention is constituted as described above, illuminance on the illuminated surface is equalized, and the second embodiment has almost the same working effects to those of the first embodiment.

In addition, it is preferable in the above-mentioned embodiments that the thickness of the light distribution lens at the thinnest portion is made to minimum value after estimating the breaking strength taking into consideration the loss of light when light passes through the lens.

What is claimed is:

1. A lighting apparatus with an illuminance equalizaing lens, comprising: an illumination light source; and a lens for illuminating a luminous vector from the light source onto an illuminated surface, an inner surface of the lens being formed as a continuous surface to receive the luminous vector from the light source in the normal direction thereof, and in order to obtain uniform illuminance on the illuminated surface, the distance $r(\phi)$ from the light source to an outer surface of the lens being defined by the following equation:

$$r(\phi) = r(\phi_1)\exp\left\{\int_{\phi_1}^{\phi - \phi_1} \tan\theta i d\phi\right\}$$

wherein $$\tan\theta_i = \frac{\sin(\theta(\phi) - \phi)}{n - \cos(\theta(\phi) - \phi)}$$

$$\theta(\phi) = \tan^{-1}\left\{\frac{1}{\cot\theta_2 + (\cot\theta_1 - \cot\theta_2)\dfrac{\int_{\phi_2}^{\phi} I(\phi)d\phi}{\int_{\phi_2}^{\phi_1} I(\phi)d\phi}}\right\}.$$

$\phi$: angle from a reference plane which is perpendicular to a line passing through the light source and the center of the outer surface $\phi_1$: angle from the reference plane to the periphery of the outer surface $\phi_2$: angle from the reference plane to the center of the outer surface $\theta_i$: incident angle of the luminous vector to the normal of the outer surface $\theta(\phi)$: angle of refraction of the luminous vector to the reference plane $\theta_1$: angle of refraction of the luminous vector to the reference plane at $\phi=\phi_1$ $\theta_2$: angle of refraction of the luminous vector to the reference plane at $\phi=\phi_2$ n: refractive index of the lens $I(\phi)$: illuminance distribution pattern from the illumination light source.

2. A lighting apparatus with illuminance equalizing lens as set forth in claim 1, wherein the illumination light source comprises a tube-shaped light source.

3. A lighting apparatus with illuminance equalizing lens as set forth in claim 1, wherein the continuous surface comprises a cylindrical surface.

4. A lighting apparatus with illuminance equalizing lens as set forth in claim 1, wherein the lens is made of a transparent material.

5. A lighting apparatus with illuminance equalizing lens as set forth in claim 1, including a reflector installed substantially along the reference plane.

6. A lighting apparatus with an illuminance equalizing lens, comprising: an illumination light source; and a lens for illuminating a luminous vector from the light source onto an illuminated surface, an inner surface of the lens being formed as a continuous surface to receive the luminous vector from the light source in the normal direction thereof, and in order to obtain the uniform illuminance on the illuminated surface, the distance $r(\phi)$ from the light source to an outer surface of the lens being defined by the following equation:

$$r(\phi) = r(\phi_1)\exp\left\{\int_{\phi_1}^{\phi - \phi_1} \tan\theta i d\phi\right\}$$

wherein $$\tan\theta_i = \frac{\sin(\theta(\phi) - \phi)}{n - \cos(\theta(\phi) - \phi)}$$

$$\theta(\phi) = \tan^{-1}\left\{\frac{1}{\cot\theta_2 + (\cot\theta_1 - \cot\theta_2)\dfrac{\int_{\phi_2}^{\phi} I(\phi)d\phi}{\int_{\phi_2}^{\phi_1} I(\phi)d\phi}}\right\}$$

$\phi$: angle from a reference plane which is perpendicular to a line passing through the light source and the center of the outer surface $\phi_1$: angle from the reference plane to the periphery of the outer surface $\phi_2$: angle from the reference plane to the center of the outer surface $\theta_i$: incident angle of the luminous vector to the normal of the outer surface $\theta(\phi)$: angle of refraction of the luminous vector to the reference plane $\theta_1$: angle of refraction of the luminous vector to the reference plane at $\phi=\phi_1$ $\theta_1$: angle of refraction of the luminous vector to the reference plane at $\phi=\phi_2$ n: refractive index of the lens $I(\phi)$: illuminance distribution pattern from the illumination light source.

7. A lighting apparatus with illuminance equalizing lens as set forth in claim 6, wherein the illumination light source comprises an electric lamp.

8. A lighting apparatus with illuminance equalizing lens as set forth in claim 6, wherein the continuous surface comprises a spherical surface.

9. A lighting apparatus with illuminance equalizing lens as set forth in claim 6, wherein the lens is made of a transparent material.

10. A lighting apparatus with illuminance equalizing lens as set forth in claim 6, including reflector installed substantially along the reference plane.

11. A lighting apparatus for illuminating a surface comprising: light-emitting means lying along a reference plane for emitting light rays; and a lens disposed to receive incident light rays emitted by the light-emitting means and direct them toward a surface to be illuminated during use of the lighting apparatus, the lens having a curved inner surface facing the light-emitting means and being shaped so that the incident light rays impinge thereon in directions normal thereto, and a curved outer surface facing toward the surface to be illuminated and having a shape defined by the following relation:

$$r(\phi) = r(\phi_1)\exp\left\{\int_{\phi_1}^{\phi-\phi_1} \tan\theta_i d\phi\right\}$$

wherein $$\tan\theta_i = \frac{\sin(\theta(\phi)-\phi)}{n-\cos(\theta(\phi)-\phi)}$$

$$\theta(\phi) = \tan^{-1}\left\{\frac{1}{\cot\theta_2 + (\cot\theta_1 - \cot\theta_2)\dfrac{\int_{\phi_2}^{\phi} I(\phi)d\phi}{\int_{\phi_2}^{\phi_1} I(\phi)d\phi}}\right\}$$

$r(\phi)$: distance r from the light-emitting means to a point on the outer surface at an angle $\phi$ from the reference plane $\phi_1$: angle from the reference plane to the end of the outer surface $\phi_2$: angle from the reference plane to the center of the outer surface $\theta_i$: incident angle of the light ray to the normal of the outer surface $\theta(\phi)$: angle of refraction of the light ray to the reference plane $\theta_1$: angle of refraction of the light ray to the reference plane at $\phi=\phi_1$ $\theta_2$: angle of refraction of the light ray to the reference plane at $\phi=\phi_2$ n: refraction index of the lens $I(\phi)$: illuminance distribution pattern from the light-emitting means.

12. A lighting apparatus according to claim 11; wherein the lens has a symmetrical shape.

13. A lighting apparatus according to claim 12; wherein the light-emitting means comprises a tubular light source having a given linear extent; and the lens has a linear extent parallel to that of the tubular light source.

14. A lighting apparatus according to claim 13; wherein the lens inner surface comprises a cylindrical surface.

15. A lighting apparatus for illuminating a surface comprising: light-emitting means lying along a reference plane for emitting light rays; and a lens disposed to receive incident light rays emitted by the light-emitting means and direct them toward a surface to be illuminated during use of the lighting apparatus, the lens having a curved inner surface facing the light-emitting means and being shaped so that the incident light rays impinge thereon in directions normal thereto, and a curved outer surface facing toward the surface to be illuminated and having a shape defined by the following relation:

$$r(\phi) = r(\phi_1)\exp\left\{\int_{\phi_1}^{\phi-\phi_1} \tan\theta_i d\phi\right\}$$

wherein $$\tan\theta_i = \frac{\sin(\theta(\phi)-\phi)}{n-\cos(\theta(\phi)-\phi)}$$

$$\theta(\phi) = \tan^{-1}\left\{\frac{1}{\cot\theta_2 + (\cot\theta_1 - \cot\theta_2)\dfrac{\int_{\phi_2}^{\phi} I(\phi)d\phi}{\int_{\phi_2}^{\phi_1} I(\phi)d\phi}}\right\}$$

$r(\phi)$: distance r from the light-emitting means to a point on the outer surface at an angle $\phi$ from the reference plane $\phi_1$: angle from the reference plane to the end of the outer surface $\phi_2$: angle from the reference plane to the center of the outer surface $\theta_i$: incident angle of the light ray to the normal of the outer surface $\theta(\phi)$: angle of refraction of the light ray to the reference plane $\theta_1$: angle of refraction of the light ray to the reference plane at $\phi=\phi_1$ $\theta_2$: angle of refraction of the light ray to the reference plane at $\phi=\phi_2$ n: refractive index of the lens $I(\phi)$: illuminance distribution pattern from the light emitting means.

16. A lighting apparatus according to claim 15; wherein the lens has a symmetrical shape.

17. A lighting apparatus according to claim 16; wherein the light-emitting means comprises means defining a generally spot light source.

18. A lighting apparatus according to claim 17; wherein the means defining a generally spot light source comprises an electric lamp.

19. A lighting apparatus according to claim 16; wherein the lens inner surface comprises a spherical surface.

* * * * *